US007839727B2

(12) United States Patent
Buttet et al.

(10) Patent No.: US 7,839,727 B2
(45) Date of Patent: Nov. 23, 2010

(54) MECHANISM FOR DISPLAYING FIGURES OR SIGNS PRODUCED ON A TIMEPIECE DIAL

(75) Inventors: Mathias Buttet, Divonne les Bains (FR); Enrico Barbasini, Ambilly (FR); Michel Navas, Collonges (FR)

(73) Assignee: BNB Concept SA (CH)

( * ) Notice: Subject to any disclaimer, the term of this patent is extended or adjusted under 35 U.S.C. 154(b) by 249 days.

(21) Appl. No.: 11/574,374

(22) PCT Filed: Aug. 31, 2004

(86) PCT No.: PCT/EP2004/009691

§ 371 (c)(1),
(2), (4) Date: Feb. 27, 2007

(87) PCT Pub. No.: WO2006/024311

PCT Pub. Date: Mar. 9, 2006

(65) Prior Publication Data

US 2008/0137487 A1 Jun. 12, 2008

(51) Int. Cl.
*G04B 19/00* (2006.01)

(52) U.S. Cl. ..... 368/223; 368/77; 368/220; 368/233

(58) Field of Classification Search ..... 368/220, 368/223, 233, 77, 37
See application file for complete search history.

(56) References Cited

U.S. PATENT DOCUMENTS

| | | | | |
|---|---|---|---|---|
| 359,227 | A * | 3/1887 | Pallweber | 368/221 |
| 5,359,578 | A * | 10/1994 | Truini | 368/76 |
| 6,507,536 | B1 * | 1/2003 | Keatch | 368/16 |
| 6,754,139 | B2 * | 6/2004 | Herbstman et al. | 368/77 |
| 7,061,833 | B2 * | 6/2006 | Dierenbach | 368/76 |
| 7,075,860 | B2 * | 7/2006 | Dias | 368/77 |
| 2003/0099159 | A1 * | 5/2003 | Herbstman et al. | 368/77 |
| 2005/0276168 | A1 * | 12/2005 | Conus et al. | 368/220 |

FOREIGN PATENT DOCUMENTS

| | | |
|---|---|---|
| DE | 94 05 308 U1 | 8/1994 |
| FR | 2 767 930 A | 3/1999 |
| JP | 07 244173 A | 9/1995 |

* cited by examiner

*Primary Examiner*—Edwin A. Leon
*Assistant Examiner*—Vanessa Girardi
(74) *Attorney, Agent, or Firm*—Ostrolenk Faber LLP

(57) ABSTRACT

The inventive mechanism comprises a series of toothed wheels meshing each with other or by groups and driven by a mobile which is connected to a basic timepiece movement by means of a mobile, wherein each toothed wheel is superimposed by a plate or disc carrying figures or signs and rotating in a corresponding bore of the timepiece dial.

14 Claims, 3 Drawing Sheets

MECHANISM FOR DISPLAYING FIGURES OR SIGNS PRODUCED ON A TIMEPIECE DIAL

CROSS REFERENCE TO RELATED APPLICATION

The present application is a 35 U.S.C. §§371 national phase conversion of PCT/EP2004/009691, filed 31 Aug. 2004. The PCT International Application was published in the French language.

BACKGROUND OF THE INVENTION

An object of the invention is a mechanism for display of animated numbers, figures or signs on a timepiece dial, especially to display the hour.

For a number of years, "novelty" models (of a "fun" or psychedelic nature) have existed on the watch market, including certain Swatches or Silberstein watches or the Opus III by Harry Winston.

These timepieces present the particularity of being original and in line with a fashion mood, but in general their major fault is difficulty in reading the time.

SUMMARY OF THE INVENTION

The display mechanism according to the invention can equip a manual winding, automatic, quartz or autoquartz basic movement and presents the particularity of animating the dial of the watch by reconstituting a given pattern for a chosen period (from one minute to 24 hours).

The display mechanism for display of animated numbers, figures or signs on a timepiece dial is characterized in that it comprises at least one toothed wheel placed under an opening of a dial of a timepiece and driven by means of a mobile which is itself linked with the basic movement of the timepiece, the toothed wheel being mounted by a small plate carrying at least one number, figure or sign designed to be animated in relation to the dial.

The display mechanism comprises several toothed wheels linked with each other or controlled separately or in groups.

The display mechanism may comprise a first series of twelve toothed wheels placed on the outer part of the mechanism and second series of six toothed wheels placed between the centre of the dial and the first series of twelve toothed wheels.

The small plates mounted on the toothed wheels may be disks designed to rotate in a corresponding opening of the dial. The disks may be positioned at the same level as the dial.

The mechanism may be constructed to animate at least one or several groups of disks. The disks are generally used to animate an image carrying a succession of numbers designed to indicate the hour. They are designed to animate the hour, but in a variant they may indicate the minute, the month, the days of the week, the seasons, the equinoxes, the solstices, day and night, etc.

The drawing represents, as an example, a mode of execution of a mechanism for display of animated figures or signs on a timepiece dial, the object of the invention.

DESCRIPTION OF A PREFERRED EMBODIMENT

Figure 1:
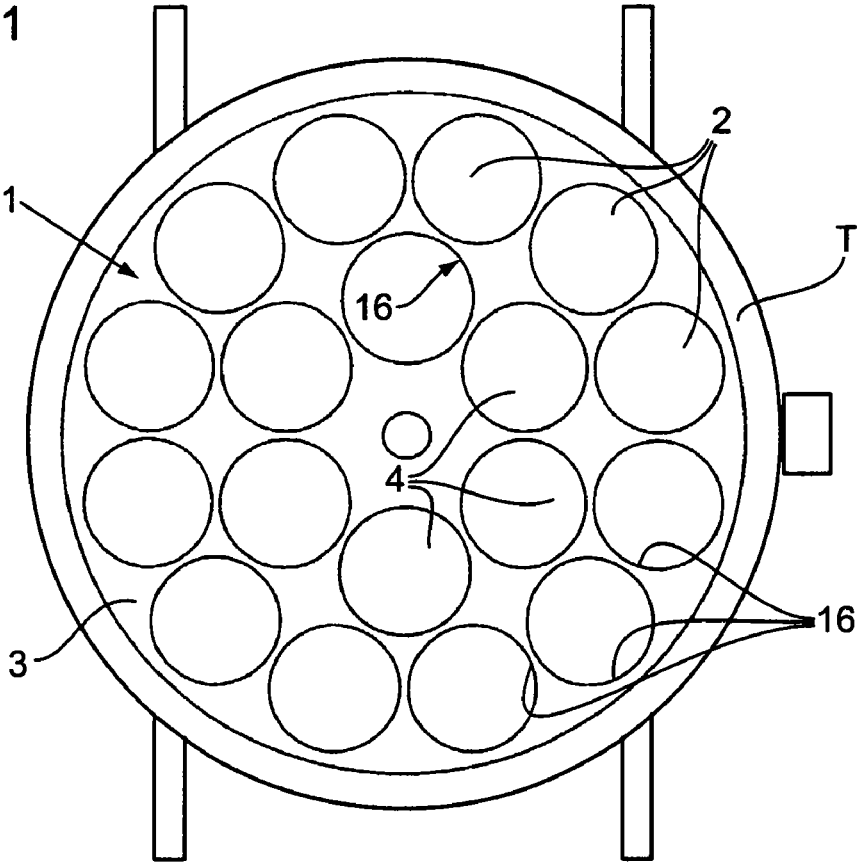
FIG. 1 is a schematic top view of the display mechanism.

The display mechanism shown in the Drawings is presented in the form of an additional module which can equip timepieces, notably a manual winding basic movement, an automatic movement or a quartz or autoquartz movement. The display mechanism may provide the effect of animating the dial of the timepiece by reconstituting successively the signs from "1" to "12" for a period chosen beforehand, corresponding to a time period of one hour.

FIG. 1 illustrates a layout of moving parts for openings (16) of the dial. This layout is not exhaustive but merely provides an illustrative example and may be modified at will.

The display mechanism (1) here illustrated as an example consists of twelve disks (2) distributed uniformly on the minute track of a dial (3) and placed midway between the positions of the hour pointers. Alternatively, the position of the disks (2) could coincide with the point at which the pointers indicating the hours are usually located.

An additional series of six disks (4) of the same diameter as the disks (2) are distributed concentrically around the dial (3) and positioned at an angular half-pitch value with respect to the first series of twelve disks (2). All of the disks (2 and 4) will be driven by other elements of the mechanism as described below and the disks (2 and 4) will be placed in corresponding openings 16 in the dial (3), so that they are in the same plane as the dial (3).

Figure 2:
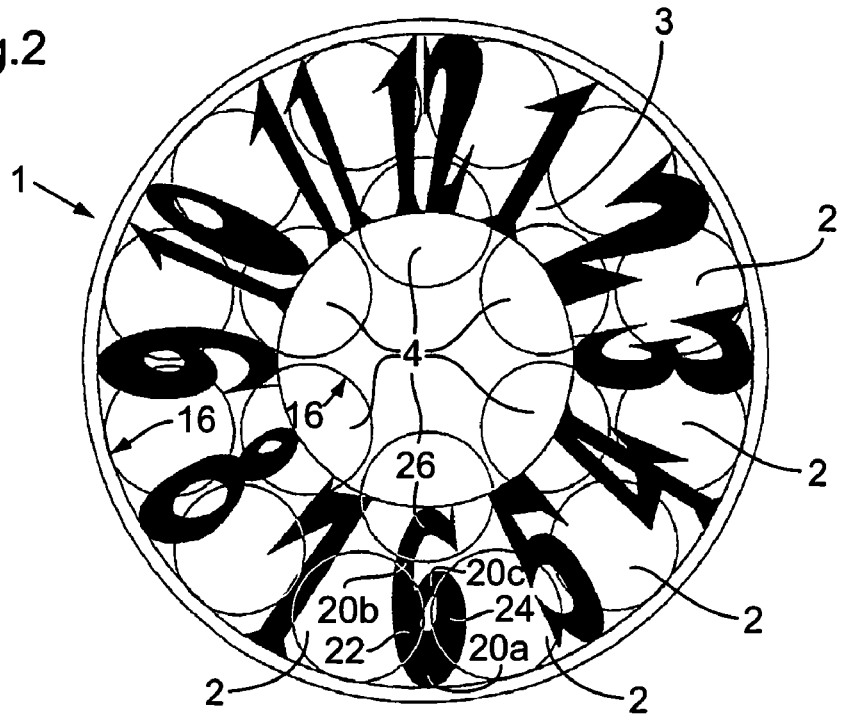
FIG. 2 is a top view of the display mechanism, the dial of the mechanism having been equipped with signs to be animated, representing the hours to be displayed.
Figure 3:
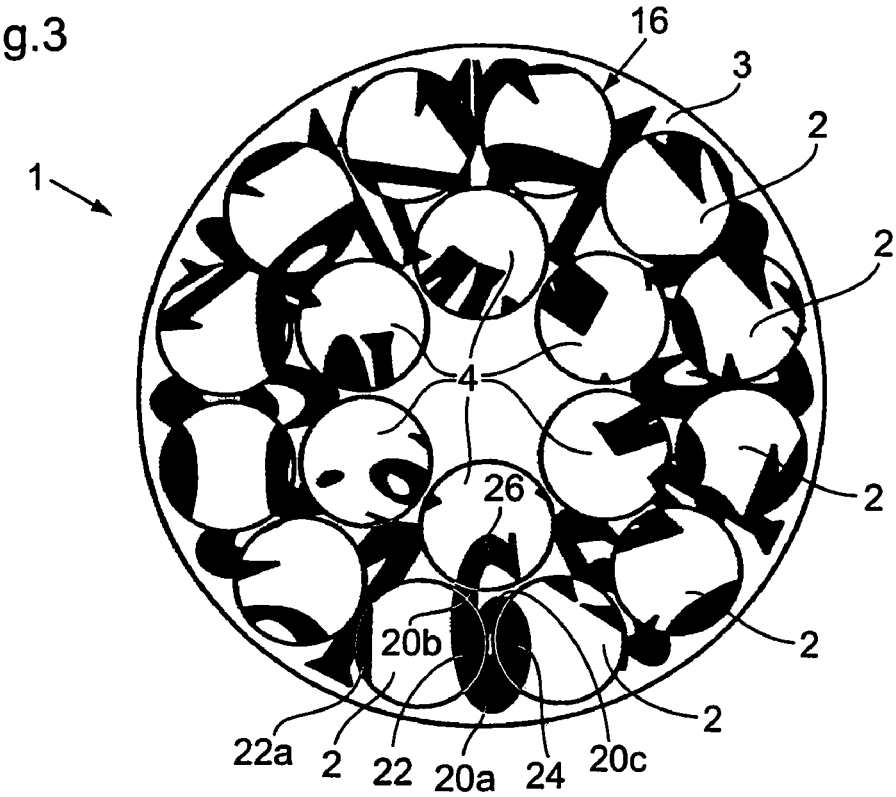
FIG. 3 is also a top view of the display mechanism 1, the mechanism having been put in motion to provide animation of a single sign at a time, the number "6" being visible.
Figure 4:
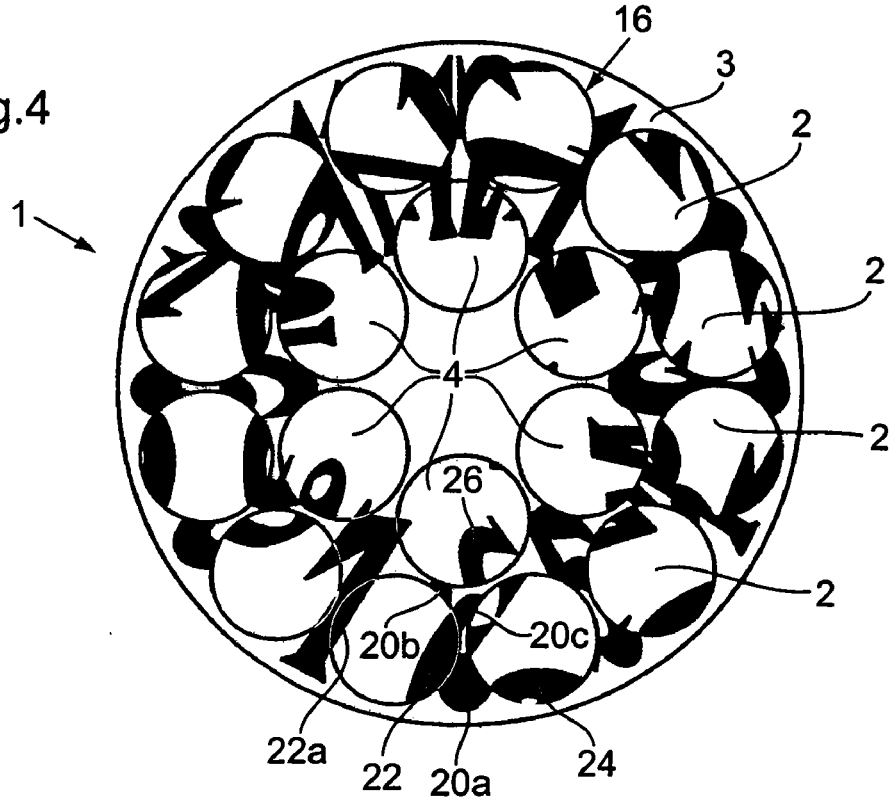
FIG. 4 is a view similar to that shown in FIG. 3 after a time period of one hour has elapsed, the dial displaying the number "7", the number "6" and all the other numbers being broken up.

When the display mechanism (1) drives the disks (2 and 4), the uncut part of the dial (3) may present a decoration which remains fixed; the eighteen disks, for their part, may be animated in rotation at a speed chosen between less than a minute and at most twelve hours (FIGS. 2 to 4). The image represented in FIG. 2 is thus broken up and the numbers are successively reconstituted after a time period of one hour.

In the case cited above, the disks (2 and 4) are trailing, that is to say they move in a continual fashion, successively forming the numbers to be displayed without ever really stopping. However, the display mechanism (1) can be constructed to stop for one hour on each number reconstituted.

FIG. 2 shows the reconstitution of the hours "1" to "12" positioned in a standard way on the dial (3) and on the disks (2 and 4).

It is clear that the dial (3) and the disks (2 and 4) animating all twelve hours of the day simultaneously will never display during normal functioning the image shown in FIG. 2.

As shown in FIGS. 3 and 4, the disks (2 and 4) are placed in an offset position, in rotation with respect to the previous disk, the speed of rotation of the eighteen disks being one revolution per hour. Thus, every hour, a single number indicating the hour will be reconstituted.

In FIG. 3 it can be seen that that the number "6" is reconstituted, being formed by a fixed part (20) (20*a*, 20*b*, 20*c*)

carried by the dial (3), a first part (22) carried by a first small plate (2), a second part (24) carried by a second small plate (2) adjacent the first plate, and a third part (26) carried by an adjacent plate (4), whereas in FIG. 4 we move on after a time period of one hour to the reconstitution of the number "7".

According to a preferred variant, the mechanism will be constructed to stop at the time of reconstitution of each number and make a jump to show the next number to be animated after a time period of one hour to show the next numeral to be animated.

Figure 5:
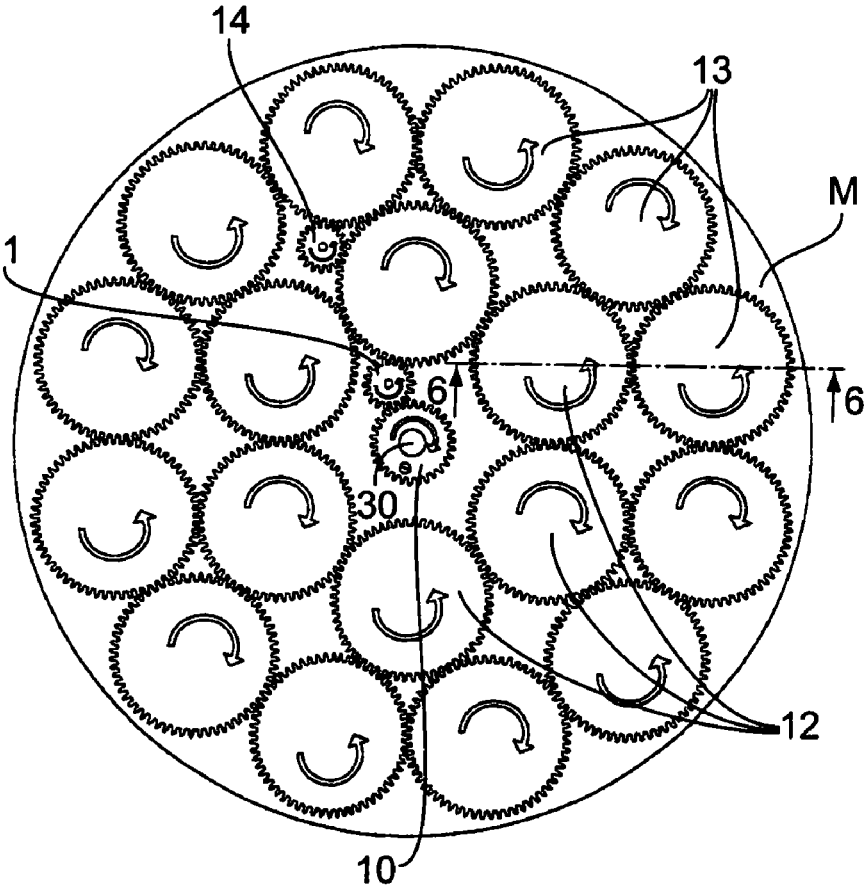
FIG. 5 is a top view of the drive device of the display mechanism shown in FIGS. 1 to 4.

The display mechanism carrying the disks (2 and 4) is represented in FIG. 5 and functions as follows: It includes the driving wheel (10) is attached to a mobile (30) which is part of the basic movement of the timepiece that is fitted with the display mechanism (1). For example, the mobile may be part of the hour wheel of a basic caliber or its minute wheel work, or any other mobile.

The driving wheel (10) rotates in the clockwise direction and meshes directly with a pinion (11) which rotates in the anti-clockwise direction. The latter drives a wheel (12) in the clockwise direction. The wheel (12) is identical to the other seventeen wheels (12 and 13) composing the mechanism (eighteen including it). These eighteen wheels successively represent the six inner wheels (12) and the twelve outer wheels (13). Each of these wheels carries a disk (2, 4). These disks are visible on the dial side and give by their movement the desired animation on the dial side. As can be seen in the drawing, these wheels (12, 13) have the same diameter. The wheel (12) rotating in the clockwise direction is positioned at the same height level as the other five wheels (12) in its group, causing the mobiles to rotate alternately in the clockwise and anti-clockwise direction. The number of wheels in the group being even, this enables the last wheel to mesh with the first wheel without blocking it as it is rotating in the opposite direction. These six wheels can therefore be driven by any one of these six wheels. In other words, the pinion (11) may be located angularly all around the driving wheel (10) in such a way as to mesh with one of the six wheels (12). These disks may be provided as patches that are attached to the wheels (12, 13).

The twelve outer wheels (13) of the same diameter as the six wheels cited above are positioned at a height different from the height of the lower wheels so that the teeth of these wheels do not touch the lower wheels (12). The mobile (14) acting on these two different heights receives its speed of rotation from the group of six wheels and redistributes it to the group of twelve wheels. This mobile (14) may be positioned at any point provided that its pitch diameter is tangent to a wheel in the inner group and tangent to a wheel in the outer group. The number of wheels in the group of twelve being even, the direction of rotation of the mobile is alternately clockwise and anti-clockwise.

Figure 6:
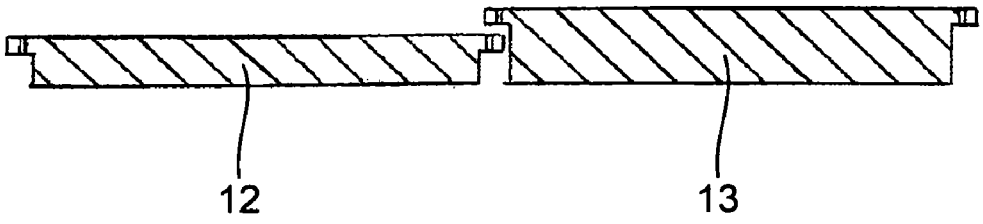
FIG. 6 is a cross section along the line 6-6 in FIG. 5.

FIG. 6 shows the two levels of meshing of the group of six wheels and the group of twelve wheels. It represents a cross section between an inner wheel (12) and an adjacent outer wheel (13). We notice in the cross section in FIG. 6 the two level heights between the inner wheels (12) and the outer wheels (13). On these wheels (12 and 13) are placed the disks shown in FIGS. 1 to 4.

The mechanism may comprise an impulse device (not shown) constructed to move the disks (2 and/or 4) in jumps, a time period of one hour being designed to elapse between successive jumps. It is thus possible to indicate the time using the eighteen disks (2 and 4), the design or image placed on the disks (13) then being the succession of numbers representing the twelve hours represented in FIGS. 3 and 4. The movement (successive recomposing of the numbers) is timed by the impulses received by the driving wheel (10) of the display mechanism from the impulse device driven by the basic movement of the timepiece. The jumping device inevitably contains a wheel which jumps, as its name suggests, from hour to hour.

The advantage of this arrangement is that it is possible to indicate the time without an hour hand if desired, the number representing the current hour being recomposed in one go and remaining displayed for a full hour.

The hour hand can be replaced by a transparent disk (sapphire disk) comprising a translucent area of a different color so as to indicate the place at which the recomposed number must be read, thus facilitating quick reading of the time.

In a variant, the hour can be indicated on the circumference of the dial only by means of the twelve disks (2) mounted on the outer wheels (13), the inner disks (4) being used to display other indications.

Generally speaking, the display mechanism described in FIGS. 1 to 6 of the drawing offers the following possibilities:

Some of the disks (2 and 4) may not appear on the dial, provided that at least two of the disks are still visible.

The disks (2 and 4) are or are not positioned at the same level as the level (0) of the dial (they may stand out or be inlaid).

The design or the decorations of these dials may or may not represent a coherent design.

The disks (2 and 4) may be provided by galvanic treatment or by all currently known means of dial decoration, i.e. mounted, jeweled, engine-turned, transferred; engraved, cut, etc.

The mechanism is constructed to perform the action of disassembling and reconstituting a single design, sign or logo or several designs, signs and logos on the same dial. In addition to the numbers, the dial may for example carry an image which will be reconstituted at a chosen time.

The mechanism may control the 12 outer disk (2) in one of the ways cited above, but rotate the 6 inner disks (4) (or only one of these disks) at a speed different from that of the 12 outer disks (2), so as to indicate for example AM/PM by means of colored disks alternately representing day and night.

With regard to the materials used: Depending on the range and quantity of the parts manufactured, the components forming the mechanism (disks (2 and 4), wheels (12, 13), etc.) may be made of machined or injected synthetic materials or machined or injected metal.

According to a preferred mode of execution, the mechanism cited as an example has an external diameter of 30 mm and contains disks visible on the dial side with a diameter of 5.7 mm. The dial has a thickness of 0.4 mm.

Obviously, for the same principle used in a smaller-sized watch, for example a ladies' watch, or a watch of intermediate size, the dimensions of the dial and the disks will be different. Finally, the number of these disks may vary between 1 and 50.

The mechanism may furthermore be used for larger timepieces (ranging from small clocks to floral clocks in squares in large towns).

The invention claimed is:

1. A mechanism for displaying a complete animated figure comprising at least one of a numeral and a sign at a dial of a timepiece, the mechanism driven by a a driving wheel attached to a mobile, the mechanism further comprising:

a first series of twelve toothed wheels mechanically linked with each other and controlled together, the twelve toothed wheels comprising an outer part of the mechanism positioned at openings of the dial;

a plurality of small plates positioned in a plane parallel to the plane of the dial with a respective plate mounted on each of the first series toothed wheels, wherein the complete animated figure comprises at least three parts, a fixed part of the three parts being fixed on the dial, a first part of the at least three parts being carried by a first plate of the plurality of small plates, and a second part of the at least three parts being carried by a second plate of the plurality of small plates, and wherein when the first plate and the second plate reach a first position and a second position, respectively, relative to the dial, the at least three parts form the complete animated figure.

2. The mechanism according to claim 1, wherein the complete animated figure comprises at least four parts, the fixed part of the at least four parts being fixed to the dial, each part of the three other parts being carried by the plurality of small plates.

3. The mechanism according to claim 1, wherein the plurality of small plates is carried by the toothed wheels belonging to the first group series, the first series being controlled by a first common pinion driven by the mobile of the timepiece.

4. The mechanism according to claim 1, wherein each plate of the plurality of small plates is positioned so as to avoid overlapping, from a direction transverse to a major surface of each plate, with any other plate of the plurality of small plates.

5. The mechanism according to claim 1, further comprising a second series of six toothed wheels positioned between a center of the dial and the first series of twelve toothed wheels.

6. The mechanism according to claim 5, wherein each plate of the small plates is a disk positioned to rotate in the opening in the dial.

7. The mechanism according to claim 5, wherein each small plate of the plurality of small plates is mounted to a respective toothed wheel and carries at least the first part of the complete animated figure and also carrying a part of a second complete animated figure different from the complete animated figure.

8. The mechanism according to claim 5, further comprising a second plurality of small plates positioned in a plane parallel to the plane of the dial with a respective plate of the second plurality mounted on each of the six second series toothed wheels.

9. The mechanism according to claim 1, wherein the plurality of small plates comprises disks, each disk positioned and configured to rotate in an opening in the dial.

10. The mechanism according to claim 9, wherein the mechanism is constructed to animate at least one or several groups of disks.

11. The mechanism according to claim 9, wherein the complete animated figure represents at least one of an hour, a minute, a month, a day of the week, a day of the month, a season, an equinox, a solstice, day and night.

12. The mechanism according to claim 9, wherein the disks and the dial comprise at least one of injected synthetic material, machined synthetic material, injected metal, or machined metal.

13. The mechanism according to claim 9, wherein the dial and the disks animate several figures.

14. The mechanism according to claim 9, wherein the plurality of small plates is carried by the toothed wheels belonging to the first series driven by the mobile, the mobile comprising a first common pinion driving the first series and a second series different from the first series of toothed wheels and driven by the mobile, the mobile further comprising a second common pinion driving the second series.

* * * * *